United States Patent [19]

Myklebust et al.

[11] Patent Number: 4,736,449

[45] Date of Patent: Apr. 5, 1988

[54] FLEXIBLE CONTAINER WITH INTEGRATED LIFTING LOOPS HAVING SEPARATE CARGO COMPARTMENT

[75] Inventors: Eirik Myklebust; Bjarne Omdal, both of Porsgrunn, Norway

[73] Assignee: Norsk Hydro a.s., Oslo, Norway

[21] Appl. No.: 897,006

[22] PCT Filed: Dec. 6, 1985

[86] PCT No.: PCT/NO85/00078

§ 371 Date: Aug. 11, 1986

§ 102(e) Date: Aug. 11, 1986

[87] PCT Pub. No.: WO86/03730

PCT Pub. Date: Jul. 3, 1986

[30] Foreign Application Priority Data

Dec. 21, 1984 [NO] Norway ..... 845159

[51] Int. Cl.[4] ..... B65D 88/16; B65D 88/22

[52] U.S. Cl. ..... 383/8; 383/36; 383/904

[58] Field of Search ..... 383/7, 8, 36, 38, 109, 383/904, 906, 6, 41, 44, 55, 56, 121; 222/105, 181

[56] References Cited

U.S. PATENT DOCUMENTS

| | | | |
|---|---|---|---|
| 172,039 | 1/1876 | Lazarevitch | 383/36 |
| 177,749 | 5/1876 | Redden | 383/36 |
| 970,767 | 9/1910 | Swingle | 383/36 |
| 2,040,336 | 5/1936 | Rosmait | 383/44 X |
| 3,171,581 | 3/1965 | Kugler | 383/906 X |
| 3,207,420 | 9/1965 | Navarrete-Kindelan | 383/904 X |
| 3,214,081 | 10/1965 | Silverstein | 383/18 |
| 3,378,190 | 4/1968 | White | 383/7 X |
| 3,587,697 | 6/1971 | Silfverskiold | 383/904 X |
| 3,604,491 | 9/1971 | Spiess | 383/121 X |
| 3,789,897 | 2/1974 | Saito | 383/109 X |
| 3,986,661 | 10/1976 | Johnson | 383/7 |
| 4,010,784 | 3/1977 | Nattrass et al. | 383/24 X |
| 4,163,723 | 1/1979 | Skaadel et al. | 383/7 |
| 4,191,229 | 3/1980 | Skaadel et al. | 383/122 X |
| 4,271,883 | 6/1981 | Krause | 383/7 |

FOREIGN PATENT DOCUMENTS

| | | | |
|---|---|---|---|
| 557775 | 5/1958 | Canada | 383/904 |
| 118112 | 9/1984 | European Pat. Off. . | |
| 172982 | 9/1975 | New Zealand . | |
| 293644 | 7/1928 | United Kingdom | 383/906 |
| 1505583 | 3/1978 | United Kingdom . | |
| 1581438 | 12/1980 | United Kingdom | 383/7 |
| 2055752 | 3/1981 | United Kingdom | 383/7 |
| 2092990 | 8/1982 | United Kingdom | 383/7 |
| 2136771 | 9/1984 | United Kingdom | 383/6 |

*Primary Examiner*—William Price
*Assistant Examiner*—Sue A. Weaver
*Attorney, Agent, or Firm*—Wenderoth, Lind & Ponack

[57] ABSTRACT

A flexible container for transportation and storage of bulk material includes integral lifting loops having openings for the insertion of lifting devices. Inside the upper part of the container is fastened a pipe-shaped piece of material having a branch pipe portion, preferably of flexible material, and separating and closing off that part of the container to be filled with bulk material, from the lifting loop. The piece of material is fastened to the walls of the container beneath the openings thereof. The branch pipe portion can serve as a filling spout. The branch pipe portion need not be provided. The pipe-shaped piece of material has a diameter which is substantially equal to that of the container.

8 Claims, 1 Drawing Sheet

FLEXIBLE CONTAINER WITH INTEGRATED LIFTING LOOPS HAVING SEPARATE CARGO COMPARTMENT

BACKGROUND OF THE INVENTION

The present invention relates to flexible containers for use in the transportation and storage of bulk material. Such a container includes integral lifting loops which are direct extensions of the side walls of the container and which form openings for lifting means.

Containers of the above mentioned type have been in use for some time and have proved to be well suited for several purposes. Usually they comprise a liner of impervious material, and when they are to be filled with free-flowing bulk material the liner is usually first inflated by air. U.S. Pat. No. 4,136,723 shows such a container having bottom flaps crossing each other. The container is preferably equipped with two integral lifting loops having a total width substantially equal to half of the container's circumference such that the lifting loops are formed by all of the longitudinal fibers of the container. By using an apparatus described in GB Pat. No. 1,505,583 a filled container can stand upright on the floor without any extra support. Its lifting loops can also hang on a hook or the like before inflation and filling of bulk material. The container is made ready for further transport after filling. This may involve enclosure of the liner and joining of the lifting loops such that one obtains a suitable loop which easily can be placed on a hook or other lifting means by pressing the lifting loops together and securing them in this position. Joining of the lifting loops to a permanent lifting grip can, however, be carried out before the container is filled with bulk material as described in Norwegian Patent Application No. 830718 (corresponding to EP No. 118,112).

During use of containers having a liner of impervious material, the function of the liner is to protect the bulk material in the container against contamination, and to close the container such that the bulk material therein will not pour out if the container capsizes, for instance because of incorrect handling. The liner often is used just to fulfil this function of preventing the bulk material from pouring out of the container, as several types of bulk material do not need to be protected against contamination.

In certain cases, especially during filling of dusty bulk material in flexible containers having at least one lifting loop, the primary function of the liner is to form a filling spout which is placed tightly around the filling pipe and thereby to prevent escape of dust during the filling operation.

The liner represents a relatively large part of the total cost of the container. The use of such a liner, if it is only to prevent the bulk material in the container from pouring out due to incorrect handling or if it is only to be used as a filling spout, is therefore not very economical.

However, several types of bulk material require protection against contamination, and a liner has to be used. When a container having integral lifting loops with or without a permanent lifting handle is used, contaminants entering through the openings in the lifting loop can get into the space between the liner and the outer container. When the container is emptied, the pressure from the bulk material against the liner which keeps it against the outer container's walls ceases, and possible contaminants in such space can follow the bulk material out of the container and contaminate the material first being discharged from the container.

Flexible containers as shown in U.S. Pat. No. 4,136,723, having a squarish bottom construction and where the container is equipped with two integral lifting loops having a total width substantially equal to half of the container's circumference, are well suited for transportation and storage of bulk material without the use of a liner of impervious material if the container is closed just below the lifting loop. A known way of doing this is, for instance, by tying a rope around the container below the lifting loops in the form of a clove hitch or the like.

Such method however has the following disadvantages.

This closing operation has to be carried out after the bulk material has been filled into the container, since the rope closes the filling spout of the container, and the capacity of the filling apparatus cannot be utilized completely.

When the container is pressed together below the lifting loop there can easily be formed channels in the gathered material such that the container will not necessarily be completely closed.

The knot in the rope can slip.

The capacity of the container cannot be fully utilized, since its net volume is reduced when the container is lashed below the filling opening.

SUMMARY OF THE INVENTION

The object of the present invention is to provide a new manner of closing the container such that the container will function without the use of a liner of impervious material and without reducing its transportation and storage capacity. Another object is to be able to close the container also when a liner is used, to thus prevent contaminants from getting into the space between the outer container and the liner such that the bulk material will not be contaminated as the container is discharged and the liner no longer presses against the outer container's walls.

One way of solving the last part of the above problem can be attained by covering the complete container with an external hood of suitable impervious material. Below the top of such a hood an opening will have to be made for insertion of lifting means into the lifting loop, thereby ensuring that no contaminants can get into the container.

Containers having four lifting loops or containers of the hood-lift type have at least two of their container walls terminating just above the filling height of the bulk material. In order to obtain excellent stability it has been common to fasten a lid of flexible material at the top of such container or to press together the container's walls above or at those places where the lifting loops are fastened to the container. If a lid is used, one can either cut a filling opening in it or fasten a filling spout to it. Elongations of the container walls can also form a filling spout. In those cases one will get a filling spout which can be closed after filling of bulk material into the container.

For these types of containers the above object is achieved by placing an external filling spout at the outer extremities of the container.

From U.S. Pat. No. 4,010,784 it is also known to equip a flexible container with four lifting loops fastened to it with a lid which is fastened around the complete circumference of the top of the container. In the lid there is a filling opening which can be closed by a rope. It is, however, difficult to obtain complete closure of the opening in this way.

For containers having integral lifting loops where the lifting loops or their total width comprise substantially one-half of the container's circumference, one can of course also place a filling spout in the container's outer wall and close such spout after filling of bulk material. But the problem is not solved as the lifting loops still will have two openings leading into the space between the container and the liner.

Another way of solving the problem is to separate that area of the container which includes the integral lifting loops from that area of the container which is to be filled by bulk material.

Previously it has been mentioned that one could close the container after having filled the container with bulk material by tying a rope around it below the lifting loop. By squeezing the container's walls together in this way one obtains a partitioning into a "lifting compartment" and a "cargo compartment". One may of course also tie the rope around the container and squeeze it together before it is filled with bulk material when one places an external filling spout in the container's wall below the place where the squeezing is executed. The capacity of the filling equipment can thereby be better utilized, but the container's lifting strength is then weakened and the capacity is reduced.

Further development of the idea of splitting the container into a lifting compartment and a cargo compartment illustrated that the problem of separating the lifting compartment and the cargo compartment could be solved relatively simply by placing a pipe-shaped member in the lifting compartment. Dimensions such as diameter and length of such member are chosen in accordance with those of the cargo compartment. After having placed such member in the container, it was fastened to the cargo compartment thereof. The two compartments are thereby separated from each other, and the lifting compartment is open for insertion of lifting means while the cargo compartment is closed for keeping the bulk material in place. However, there must be a possibility for filling bulk material into the cargo compartment. It has been found that by placing a branch pipe-shaped member in the above described pipe-shaped member, the former can be drawn out through one of the openings of the lifting loop or a central filling opening such that it can be used as a filling spout since it leads directly into the container's cargo compartment.

The special features of the invention are accordingly that the cargo compartment is closed by placing a pipe-shaped piece of material, having a branch pipe-shaped member, inside the container which thereby is divided in a lifting compartment and a cargo compartment. The branch pipe-shaped member of the pipe-shaped piece of material then serves as a filling spout such that the bulk material can be led into the cargo compartment. The filling spout can be drawn out through one of two openings of the lifting loop or through a central filling opening and can be closed after termination of the filling operation.

BRIEF DESCRIPTION OF THE DRAWINGS

The invention will now be further explained in connection with the accompanying drawings which illustrate preferred embodiments of the invention.

DETAILED DESCRIPTION OF THE INVENTION

Figure 1:
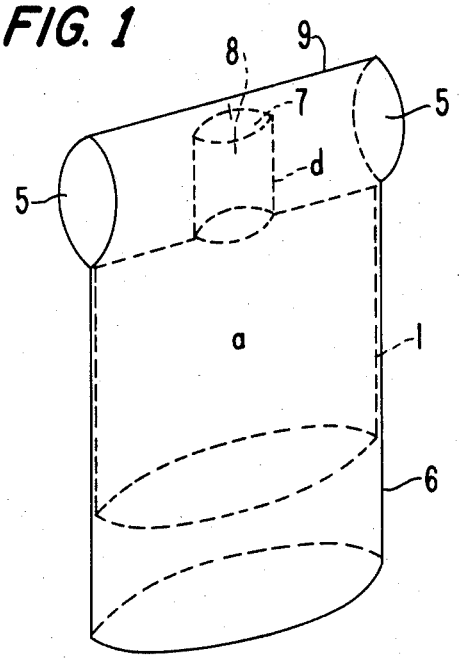
FIG. 1 is a schematic perspective view of a container in which there is fastened a pipe-shaped flexible piece of material having a branch pipe-shaped member according to the invention.

FIG. 1 shows a container (6) in which there is fastened a pipe-shaped flexible piece of material (1) which is connected to the inner walls of the container (6). The piece of material (1) can be fastened vertically to the walls of the container (6) or horizontally around its circumference by seams, glue, etc. Such piece of material includes a main pipe section (a) which has a diameter substantially equal to that of the container, which is open at its lower end, and which is closed in its upper end except for a branch pipe-shaped portion (d) opening thereinto. During filling of bulk material, the branch pipe portion (d) is drawn out through one of two side openings or "armpits" (5) or through a central slit (8). The branch pipe (d) is shown located symmetrically but can be positioned asymmetrically. The branch pipe portion (d) is lashed after the filling operation is completed, and a lifting loop (9) is made ready for insertion of lifting means through the openings (5). The bulk material is now closed in by the piece of material (1) and cannot pour out of the container (6), e.g. through openings (5) or slit (8).

Figure 2:
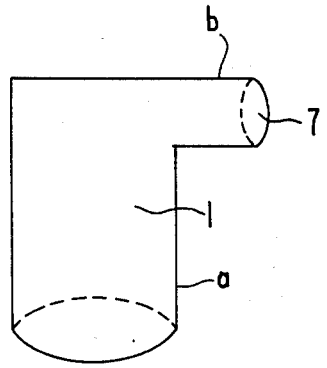
FIG. 2 is a similar view of a modified piece of material.

FIG. 2 shows a modification wherein pipe-shaped piece of material (1) has extending from a side wall thereof a branch pipe portion (b). Main pipe portion (a) may have a diameter substantially equal to that of the container and can be fastened to the side walls of the container (6) and/or along its circumference and below its opening (5).

Figure 4:
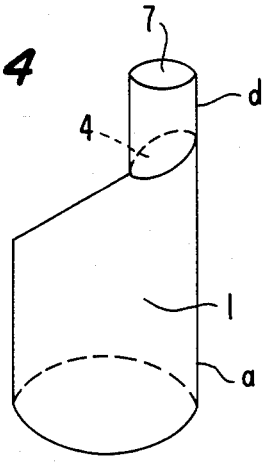
FIGS. 4 and 5 are views similar to FIG. 3 but showing alternative arrangements thereof.
Figure 3:
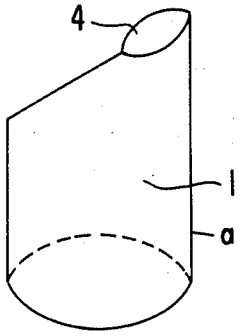
FIG. 3 is a similar view of a further modified piece of material.
Figure 5:
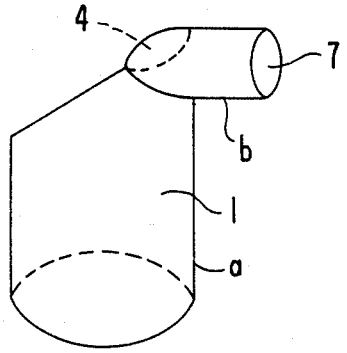

FIGS. 3–5 show a further modification wherein pipe-shaped piece of material (1) has the upper end thereof cut off, for instance in order to reduce consumption of material, to thereby form the top of main pipe portion (a) as a slanted cover, in the top of which is an opening (4) to which can be fastened an upwardly extending branch pipe portion (d) (FIG. 4) or a laterally extending branch pipe portion (b) (FIG. 5). Branch pipe portions (b) or (d) will then be the filling spout itself, which is lashed after a filling operation. When the length of the branch pipe portion is equal to 0, i.e. the arrangement of FIG. 3, then the upper end of the cone-shaped portion must be closed after filling. The piece of material (1) is fastened to the container (6) such that at least the cone-shaped portion lies above the height to which the bulk material is filled.

If a liner is used in the container (6), the filling opening of the liner will of course be drawn into the filling spout in the pipe-shaped piece of material (1). Filling of bulk material will of course take place in such a way that no bulk material will get into the space between the outside of the liner and the pipe-shaped piece of material (1).

By means of the present invention it is possible in a simple manner to prevent bulk material from spilling from a container having integral lifting loops if it capsizes. Further, contaminants cannot damage a liner of the container. Also, contaminants cannot get into a space between the container walls and the liner and during discharge follow the bulk material and thereby contaminate it. In spite of the fact that closing means have been placed between the lifting compartment and the cargo compartment simple filling of bulk material can still be obtained.

We claim:

1. In a flexible container for transportation and storage of bulk material and including an interior having a lower cargo compartment to be filled with bulk material and defined by side walls, and an upper lifting compartment defined by integral lifting loops which are formed by direct extensions of the material of said side walls, and lifting openings through said material to said interior of said container for the receipt of lifting means, whereby bulk material may be filled into said cargo compartment via said lifting compartment through one of said lifting openings or through a filling opening in the top of said container, the improvement of means for separating said cargo compartment from said lifting compartment, for maintaining said lifting openings open for the receipt of lifting means, and for closing said cargo compartment to prevent spillage therefrom of bulk material filled therein, said separating means comprising:

a pipe-shaped member positioned within the upper part of said container and including a main pipe portion having a diameter substantially equal to the diameter of said container, an open bottom opening into said cargo compartment and a closed top separating said cargo compartment from said lifting compartment, said main pipe portion being fastened to said container side walls; and branch pipe means, extending from said pipe portion within said lifting compartment and formed of a flexible material, for being drawn out through one of said lifting or filling openings during a filling operation and thereby for forming a filling spout for filling bulk material therethrough and through said main pipe portion into said cargo compartment, and for being withdrawn from said one opening and being closed after completion of such filling operation and thereby closing the thus filled said cargo compartment.

2. The improvement claimed in claim 1, wherein said branch pipe means comprises a branch pipe portion having a diameter less than said diameter of said main pipe portion, said branch pipe portion being connected to said top of said main pipe portion and extending upwardly therefrom.

3. The improvement claimed in claim 2, wherein said branch pipe portion is connected to said top symmetrically of said main pipe portion.

4. The improvement claimed in claim 2, wherein said branch pipe portion is connected to said top asymmetrically of said main pipe portion.

5. The improvement claimed in claim 1, wherein said branch pipe means comprises a branch pipe portion having a diameter less than said diameter of said main pipe portion, said branch pipe portion being connected to said top of said main pipe portion and extending laterally therefrom.

6. The improvement claimed in claim 1, wherein said top of said main pipe portion is inclined upwardly to an upper corner thereof having an opening, and said branch pipe means comprises said inclined top.

7. The improvement claimed in claim 1, wherein said top of said main pipe portion is inclined upwardly to an upper corner thereof, and said branch pipe means comprises a branch pipe portion connected to said upper corner and extending upwardly therefrom.

8. The improvement claimed in claim 1, wherein said top of said main pipe portion is inclined upwardly to an upper corner thereof, and said branch pipe means comprises a branch pipe portion connected to said corner and extending laterally therefrom.

* * * * *